United States Patent [19]

Luthi et al.

[11] Patent Number: 5,047,116

[45] Date of Patent: Sep. 10, 1991

[54] METHOD FOR PRODUCING LIQUID TRANSFER ARTICLES

[75] Inventors: Pierre Luthi, Mornex, France; Christian Hidber, Thonex, Switzerland

[73] Assignee: Union Carbide Coatings Service Technology Corporation, Danbury, Conn.

[21] Appl. No.: 359,166

[22] Filed: May 31, 1989

[51] Int. Cl.[5] ..... B05D 3/06; B05D 5/00; B44C 1/22

[52] U.S. Cl. ..... 156/643; 156/659.1; 427/53.1; 427/259; 427/270

[58] Field of Search ..... 156/643, 632, 633, 634, 156/656, 659.1, 667; 427/53.1, 54.1, 56.1, 259, 270, 272

[56] References Cited

U.S. PATENT DOCUMENTS

| | | | |
|---|---|---|---|
| 3,645,744 | 2/1972 | Fulkerson et al. | 96/115 |
| 3,726,685 | 4/1973 | Philpot et al. | 96/86 |
| 4,062,686 | 12/1977 | Van Allan et al. | 96/115 |
| 4,108,659 | 8/1978 | Dini | 156/634 |
| 4,379,818 | 4/1983 | Lock et al. | 156/654 |
| 4,504,354 | 3/1985 | George et al. | 427/53.1 |
| 4,566,938 | 1/1986 | Jenkins et al. | 427/53.1 |

FOREIGN PATENT DOCUMENTS 2049102A 12/1980 United Kingdom .

*Primary Examiner*—Norman Morgenstern
*Assistant Examiner*—Marianne L. Padgett
*Attorney, Agent, or Firm*—Cornelius F. O'Brien

[57] ABSTRACT

The invention relates to a method for producing a liquid transfer article for use in transferring the liquid to another surface comprising the steps of:

(a) coating an article with at least one layer of a coating material selected from the group consisting of ceramic and metallic carbides;

(b) superimposing over the coated surface a removable mask material of discontinuous material opaque to a beam of radiation of a selected energy level;

(c) directing a laser having a beam of radiation of said selected energy level onto the coated surface of the article so as to produce in the area of the coated surface not covered by the discontinuous material a pattern of wells adapted for receiving liquid and wherein said pattern of wells is defined by the area of the coated surface which is not covered by the discontinuous material; and (d) removing the mask material from the coated article.

17 Claims, 2 Drawing Sheets

METHOD FOR PRODUCING LIQUID TRANSFER ARTICLES

FIELD OF THE INVENTION

The present invention relates to a method for producing a liquid transfer article for use in transferring an accurately metered quantity of a liquid to another surface. An example of such a liquid transfer article is a roll for use in gravure printing processes. The liquid transfer article is produced by coating a substrate with a ceramic or metallic carbide layer, superimposing over coated layer a removable mask of discontinuous material opaque to radiation, and then directing a laser beam of radiation onto the mask and coated surface to produce on the area of the coated surface not covered by the mask of discontinuous material a pattern of depressions or wells adapted for receiving liquid.

BACKGROUND OF THE INVENTION

A liquid transfer article, such as a roll, is used in the printing industry to transfer a specified amount of a liquid, such as ink or other substances, from the liquid transfer article to another surface. The liquid transfer article generally comprises a surface with a pattern of depressions or wells adapted for receiving a liquid and in which said pattern is transferred to another surface when contacted by the liquid transfer article. When the liquid is ink and the ink is applied to the article, the wells are filled with the ink while the remaining surface of the article is wiped off. Since the ink is contained only in the pattern defined by the wells, it is this pattern that is transferred to another surface.

In commercial practice, a wiper or doctor blade is used to remove any excess liquid from the surface of the liquid transfer article. If the surface of the coated article is too coarse, excessive liquid, such as ink, will not be removed from the land area surface of the coarse article thereby resulting in the transfer of too much ink onto the receiving surface and/or on the wrong place. Therefore, the surface of the liquid transfer article should be finished and the wells or depressions clearly defined so that they can accept the liquid.

A gravure-type roll is commonly used as a liquid transfer roll. A gravure-type roll is also referred to as an applicator or pattern roll. A gravure roll is produced by cutting or engraving various sizes of wells into portions of the roll surface. These wells are filled with liquid and then the liquid is transferred to the receiving surface. The diameter and depth of the wells may be varied to control the volume of liquid transfer. It is the location of the wells that provides a pattern of the liquid to be transferred to the receiving surface while the land area defining the wells does not contain any liquid and therefore cannot transfer any liquid. The land area is at a common surface level, such that when liquid is applied to the surface and the liquid fills or floods the wells, excess liquid can be removed from the land area by wiping across the roll surface with a doctor blade.

The depth and size of each well determines the amount of liquid which is transferred to the receiving surface. By controlling the depth and size of the wells, and the location of the wells (pattern) on the surface, a precise control of the volume of liquid to be transferred and the location of the liquid to be transferred to a receiving surface can be achieved. In addition, the liquid may be transferred to a receiving surface in a predetermined pattern to a high degree of precision having different print densities by having various depth and/or size of wells.

Typically, a gravure roll is a metal with an outer layer of copper. Generally, the engraving techniques employed to engrave the copper are mechanical processes, e.q., using a diamond stylus to dig the well pattern, or photochemical processes that chemically etch the well pattern.

After completion of the engraving, the copper surface is usually plated with chrome. This last step is required to improve the wear life of the engraved copper surface of the roll. Without the chrome plating, the roll wears quickly, and is more easily corroded by the inks used in the printing. For this reason, without the chrome plating, the copper roll has an unacceptably low life.

However, even with chrome plating, the life of the roll is often unacceptably short. This is due to the abrasive nature of the fluids and the scrapping action caused by the doctor blade. In many applications, the rapid wear of the roll is compensated by providing an oversized roll with wells having oversized depths. However, this roll has the disadvantage of higher liquid transfer when the roll is new. In addition, as the roll wears, the volume of liquid transferred to a receiving surface rapidly decreases thereby causing quality control problems. The rapid wear of the chrome-plated copper roll also results in considerable downtime and maintenance costs.

Ceramic coatings have been used for many years for anilox rolls to give extremely long life. Anilox rolls are liquid transfer rolls which transfer a uniform liquid volume over the entire working surface of the rolls. Engraving of ceramic coated rolls cannot be done with conventional engraving methods used for engraving copper rolls; so these rolls must be engraved with a high energy beam, such as a laser or an electron beam. Laser engraving results in the formation of wells with a new recast surface about each well and above the original surface of the roll, such recast surface having an appearance of a miniature volcano crater about each well. This is caused by solidification of the molten material thrown from the surface when struck by the high energy beam.

The recast surfaces may not significantly effect the function of an anilox roll because the complete anilox roll is engraved and has no pattern. However, in gravure printing processes where a liquid transfer pattern is required, the recast surfaces cause significant problems. The major difference between a gravure roll and an anilox roll is that the entire anilox roll surface is engraved whereas with a gravure roll only portions of the roll are engraved to form a predetermined pattern. In order for the gravure roll to transfer liquid in a controlled manner determined by the pattern, fluid has to be completely wiped from the unengraved land area by a doctor blade. Any fluid remaining on the land area after running under the doctor blade will be deposited on the receiving product where it is not wanted. With a laser engraved ceramic roll, the doctor blade cannot completely remove liquid from the land area due to the recast surfaces which retain some of the liquid. Thus the recast surfaces should be removed for most printing applications.

When using laser techniques to produce liquid transfer articles for applications requiring printed patterns, it is extremely difficult to control the depth and size of all the wells. Specifically, the laser is generally required to be activated only where wells are required and inactivated when no wells are required. Unfortunately, the laser start and stop response is not the same response that is achieved once the laser is operating for a set period. For example, when the laser is started, the first few pulses of radiation are less than the energy content of the laser beam for pulses produced after the laser has been operating for a suitable time. This in turn results in the shape and depth of the first few wells in the surface of the article being different from consecutive successive wells formed in the surface of the article. Consequently, the wells defining the boundary of the pattern are not the same depth and/or size as the wells contained within the center of the pattern and therefore would be incapable of containing a desired volume of liquid. This results in the boundary of the pattern transferred to a receiving surface being off shaded with respect to the overall pattern. In other words, the edges of the printed pattern are somewhat fuzzy. This can result in different shades of the printed pattern being transferred to the receiving surface. Although laser techniques provide an effective means for producing wells in the surface of liquid transfer articles, the non-uniformity of the few start and stop pulses of the laser can produce an inferior quality liquid transfer article. With regard to the location of the wells, a sharp boundary line of patterns generally requires a combination of full and fractional size surface area wells to ensure that a good boundry edge definition is obtained. Without a mask, a sharp boundry edge definition cannot be achieved.

An object of the present invention is to provide a method for producing a liquid transfer article having uniform size and depth wells on its surface.

Another object of the present invention is to provide a method for producing a quality liquid transfer roll that can be used in gravure printing processes to provide printed patterns of desired shapes and shades that cannot effectively be obtained using conventional stencils.

Another object of the present invention is to provide a method for producing a gravure roll having desired size and depth wells adapted for receiving liquid which can then be transferred to a receiving surface to produce a predetermined shape and shade of printed patterns on the receiving surface.

Another object of the present invention is to provide a method for producing a gravure roll having desired size and depth wells adapted for receiving liquid which can then be transferred to a receiving surface to produce a predetermined printed pattern without fuzzy edges defining said printed pattern.

The above and further objects and advantages of this invention will become apparent upon consideration of the following description thereof.

SUMMARY OF THE INVENTION

The invention relates to a method for producing a liquid transfer article for use in transferring the liquid to another surface comprising the steps of:

(a) coating an article with at least one layer of a coating material selected from the group consisting of ceramic and metallic carbides;

(b) superimposing over the coated surface a removable mask material of discontinuous material opaque to a beam of radiation of a selected energy level;

(c) directing a laser having a beam of radiation of said selected energy level onto the coated surface of the article so as to produce in the area of the coated surface not covered by the discontinuous material a pattern of wells adapted for receiving liquid and wherein said pattern of wells is defined by the area of the coated surface which is not covered by the discontinuous material; and (d) removing material from the coated article.

Generally, after the application of the coating in step (a), the coated surface could be finished by conventional grinding techniques to the desired dimensions and tolerances of the coated surface. The coated surface could also be finished to a roughness of about 20 micro-inches $R_a$ or less, preferably about 10 micro-inches $R_a$ or less, in order to provide an even surface for a laser treatment.

As used herein, $R_a$ is the average surface roughness measured in micro-inches by ANSI Method B46.1, 1978. In this measuring system, the higher the number, the rougher the surface.

Preferably, the recast areas formed about each well of the laser treated article should be treated or finished so as to smooth substantial portions of the surface of the recast areas to a roughness of 6 micro-inches $R_a$ or less, preferably 4 micro-inches $R_a$ or less. Consequently, the surface of the laser treated article should be finished to a roughness of 6 micro-inches $R_a$ or less for most printing applications.

If desired, a sealant could be used to seal the coated article after step (a). A suitable sealant would be an epoxy sealant such as UCAR 100 sealant which is obtainable from Union Carbide Corporation, Danbury, Conn. UCAR 100 is a trademark of Union Carbide Corporation for a thermosetting epoxy resin containing DGEBA. The sealant can effectively seal fine microporosity that may be developed during the coating process and therefore provide resistance to water and alkaline solutions that may be encountered during the end use of the coated article while also providing resistance to contaminations that may be encountered during handling of the coated article.

As used herein, a material opaque to a beam of radiation, such as a pulse laser beam, shall mean a material that absorbs and/or reflects the beam of radiation so that the radiation beam is not transmitted through the material to contact the surface covered by the material. The particular opaque material selected must be sufficiently thick to absorb and/or reflect the beam of radiation so as to prevent penetration of the beam through the material.

As used herein a discontinuous material is one that is composed of generally two or more independent surface areas of the material that are not connected together and that can be arranged in any manner to produce an overall pattern.

One embodiment of the invention relates to a method for producing a liquid transfer article for use in transferring the liquid to another surface comprising the steps:

(a) coating an article with at least one layer of a coating material selected from the group consisting of ceramic and metallic carbides;

(b) superimposing over the coated surface a removable mask material composed of a two-layer film having a first layer substantially transparent to a beam of radiation of a selected energy level and disposed on said first layer a second layer of a discontinuous material opaque to the beam of radiation of said selected energy level thereby providing a pattern in the first layer defined as the area of the first layer not covered by the second layer; and (c) directing a laser having a beam of radiation of said selected energy level through the two-layer film onto the coated surface of the article so as to produce in the coated surface a pattern of wells adapted for receiving liquid and wherein said pattern of wells is defined by the area of the first layer which is not covered by the opaque material of the second layer of the two-layer film.

The two-layer film suitable for use in one embodiment of the invention comprises a first layer substantially transparent to radiation waves so that the radiation waves can effectively permeate through the first layer, and a second layer of discontinuous areas of a material that absorbs and/or reflects radiation waves. Copper-clad laminates for printed circuitry applications are the types of two-layer film that can be used in this invention. The radiation transparent layer can be composed of a large number of plastic materials which can be formed into a sheet and which can effectively permit the radiation waves or pulses to substantially penetrate through the material where they can contact a surface covered by the plastic material. Suitable materials for the transparent layer would be polyester film such as Mylar polyester film. Mylar is a trademark of E. I. DuPont de Nemours & Co. for a highly durable, transparent water-repellent film of polyethylene terephthalite resin. Due to the composition of many plastic films, the films are generally not completely transparent to laser pulses, and thus could be destroyed during the laser operation. Consequently, in many applications the plastic film may be destroyed and therefore not reusable. The material opaque to radiator waves could be any metal that absorbs and/or reflects radiation such as copper, nickel, gold and the like. Preferably, copper and nickel could be used as the radiation absorber layer with copper being the most preferred. If the material opaque to radiation waves is one that absorbes the radiation waves then the material shall be sufficiently thick so that it can conduct any heat generated from the radiation waves without damaging the article covered by the material.

The two-layer film can be prepared by bonding a material such as copper foil to a laminate sheet made of a material such as Mylar polyester film. A pattern is then applied to the copper layer using a non-etchable protective coating and then the exposed unprotected copper is etched away. The area not covered by the copper defines a pattern on the radiation transparent layer through which the laser pulses of radiation can pass. Thus when using an appropriate laser device, the pattern in the radiation transparent layer defined as the area not covered by the discontinuous radiation absorber material (copper) can be imparted to the liquid transfer article as a pattern of wells.

The thickness and material of each layer of the film along with the energy and frequency of the beam of radiation of the pulses from the laser will determine the shape and depth of each indentation into the liquid transfer article. Preferably for most rolls for use in gravure printing processes, the first layer of the two-layer film should be between about 10 and 100 microns thick, more preferably about 35 microns thick and be made of Mylar polyester. The radiation opaque layer when composed of copper should be between 25 and 200 microns thick, most preferably about 100 microns thick.

The first layer of the two-layer film should be transparent to a beam of radiation (laser pulse) of 0.10 millijoules or higher. The second layer of the two-layer film should absorb and/or reflect the beam of radiation of 0.10 millijoules or higher. Depending on the specific two-layer film used, any laser can be employed having the appropriate power to produce beams or pulses of radiation that are absorbed and/or reflected by the second layer and transmitted through the first layer to contact the liquid transfer article and impart wells of predesired size and shape.

In operation, the two-layer film is superimposed over the coated surface of the liquid transfer article and using a conventional laser, a pattern of wells can be imparted to the surface of the liquid transfer article. If the liquid transfer article is a cylindrical roll, then the two-layer film could be a hollow cylinder that slips over the roll or the two-layer film could be a sheet that could be wrapped around the roll. Using relative movement between the laser and the film covered roll, the desired pattern of wells could be imparted onto the roll. Using the subject invention, the wells defining the pattern could be of uniform and depth. The roll for use in gravure printing processes could be made of aluminum, or steel, preferably steel.

Another embodiment of the invention is directed to a method for producing a liquid transfer article comprising the steps of:

(a) coating an article with at least one layer of a coating material selected from the group consisting of ceramic and metallic carbides;

(b) depositing on the coated surface of the article a mask material opaque to a beam radiation of a selected energy level;

(c) depositing a resist layer of discontinuous areas on the mask material to produce on the exposed areas of the mask material not covered by the resist layer a desired pattern;

(d) removing the exposed area of the mask material not covered by the resist layer thereby by forming a desired pattern on the exposed surface of the coated material;

(e) directing a laser having a beam of radiation onto the surface of the article where it will produce in the surface of the exposed area of the coating material not covered by the mask material a pattern of wells adapted for receiving liquid while the mask material prevents penetration of the beam of radiation through said mask material thereby protecting the area of the coating material covered by said mask material; and (f) removing said mask material from the article.

If desired, the resist material deposited on the mask material in step (c) could be removed prior to implementing step (e). Also, to obtain a better adhesion of the mask material to the coated surface; the coated article in step (a) could be laser treated using a relatively small beam of radiation to produce a surface with a plurality of small wells. A laser engraving of wells 1 to 8 microns in depth, preferably about 4 microns in depth and disposed at 200 to 300 lines per centimeter would be suitable for most applications.

The preferred mask material would be copper which could be deposited on the coated article using conventional techniques such as plasma spray coating. If desired, the deposited layer of mask material could be polished or otherwise finished to produce a smooth surface.

It is known that certain resist materials, such as polymers, which initially are soluble in organic solvents, become insoluble in the same solvent after exposure to an appropriate light source. Thus if one of these resist materials is deposited on a layer of mask material and exposed to light radiation, on certain areas, the areas exposed to light will become insoluble and the unexposed areas of resist material will remain soluble. The desired pattern to be laser-engraved on the article can be formed by the unexposed areas on the resist layer so that such unexposed areas can be dissolved to expose the mask material which can then be removed by chemical or mechanical means. The remaining areas of resist coated mask material will be opaque to a beam of radiation, such as pulse laser, and therefore when the article is laser-engraved only the exposed coated areas of the article will be penetrated by the laser beam. If desired, the resist layer could be appropriately removed prior to the laser engraving by dissolving in a suitable solvent. If the resist layer is left on the portion of the mask layer that is not removed, then the resist layer and mask layer could be removed after the laser engraving by chemical or mechanical means. The article could then be appropriately finished to a desired roughness by grinding or the like in order to provide a smooth flat surface in which a doctor blade can easily and efficiently remove any liquid on such surface. Thus the laser-engraved wells will contain the liquid while the remaining areas of the article will be flat so that any liquid on the flat surface can be easily removed by a doctor blade.

Any suitable resist material can be employed that will not dissolve or be effected when the selected portions of the mask material is to be removed. For example, when the mask material is copper, the resist material should not be effected by an etching solution that will be used to remove the exposed areas of copper on the article. Suitable resist materials are polymer of the type disclosed in U.S. Pat. Nos. 4,062,686; 3,726,685 and 3,645,744. These references are incorporated herein as if the full text were presented.

Any suitable ceramic coating, such as a refractory oxide or metallic carbide coating, may be applied to the surface of the roll. For example, tungsten carbide-cobalt, tungsten carbide-nickel, tungsten carbide-cobalt chromium, tungsten carbide-nickel chromium, chromium-nickel, aluminum oxide, chromium carbide-nickel chromium, chromium carbide-cobalt chromium, tungsten-titanium carbide-nickel, cobalt alloys, oxide dispersion in cobalt alloys, aluminum-titania, copper based alloys, chromium based alloys, chromium oxide, chromium oxide plus aluminum oxide, titanium oxide, titanium plus aluminum oxide, iron based alloys, oxide dispersed in iron based alloys, nickel and nickel based alloys, and the like may be used. Preferably chromium oxide ($Cr_2O_3$), aluminum oxide ($Al_2O_3$), silicon oxide or mixtures thereof could be used as the coating material, with chromium oxide being the most preferred.

The ceramic or metallic carbide coatings can be applied to the metal surface of the roll by either of two well known techniques; namely, the detonation gun process or the plasma coating process. The detonation gun process is well known and fully described in U.S. Pat Nos. 2,714,563; 4,173,685; and 4,519,840, the disclosure of which are hereby incorporated by reference. Conventional plasma techniques for coating a substrate are described in U.S. Pat Nos. 3,016,447; 3,914,573; 3,958,097; 4,173,685; and 4,519,840, the disclosures of which are incorporated herein by reference. The thickness of the coating applied by either the plasma process or D-gun process can range from 0.5 to 100 mils and the roughness ranges from about 50 to about 1000 $R_a$ depending on the process, i.e. D-gun or plasma, the type of coating material, and the thickness of the coating.

As stated above, the ceramic or metallic carbide coating on the roll can be preferably treated with a suitable pore sealant such as an epoxy sealant, e.g. UCAR 100 epoxy available from Union Carbide Corporation. The treatment seals the pores to prevent moisture or other corrosive materials from penetrating through the ceramic or metallic carbide coating to attack and degrade the underlying steel structure of the roll.

After application of the coating, it is finished by conventional grinding techniques to the desired dimensions and tolerances of the roll surface and for a smoothness of between about 20 micro-inches $R_a$ and about 10 micro-inches $R_a$, in order to provide an even surface for a laser treatment.

The volume of the liquid to be transferred is controlled by the volume (depth and diameter) of each well and the number of wells per unit area. The depths of the laser-formed wells can vary from a few microns such as 2 or less to as much as 250 microns or more. The average diameter of each well, of course, is controlled by the pattern and the number of laser-formed wells per lineal inch. Preferably the area on the surface of the roll is divided into two portions forming a non-uniform distribution or pattern of wells upon the surface. One portion comprises wells in a uniform pattern, such as a square pattern, a 30 degree pattern, or a 45 degree pattern with the number of laser-formed wells per lineal inch typically being from 80 to 550 and the remaining second portion being free of wells (land areas). At the transition between the well-containing and land areas, the presence of recast upon the land areas would result in ink smearing into the well-free portion when a doctor blade is passed over the surface to remove fluid. By providing recast free land areas in the land areas between the wells, this problem is avoided.

A wide variety of laser machines are available for forming wells in the ceramic or metallic carbide coatings. In general, lasers capable of producing a beam or pulse of radiation of from 0.0001 to 0.4 joule per laser pulse for a duration of 10 to 300 microseconds can be used. The laser pulses can be separated by 30 to 2000 microseconds depending on the specific pattern of well desired. Higher or lower values of the energy and time periods can be employed and other laser-engraved techniques readily available in the art can be used for this invention. After laser-engraving, the roughness should typically range from 20 to 1000 micro-inches $R_a$ and the wells can range from 10 microns to 300 microns in diameter and from 2 microns to 250 microns in height.

After the laser treatment of the coated surface of the liquid transfer article, the coated surface can be finished to less than about 6 micro-inches $R_a$ using a microfinishing (also called superfinishing) technique, such as described in "Roll Superfinishing with Coated Abrasives," by Alan P. Dinsberg, in Carbide and Tool Journal, March/April 1988 publication. Microfinishing techniques provide a predictable, consistent surface finish over the entire length of the engraved roll, and provide a surface free of recast. Therefore, all unwanted fluid can be removed from the land areas by a doctor blade. Furthermore, microfinishing techniques can provide the desired finish of the coated article.

The liquid that can be transferred to a receiving surface is any liquid such as ink, liquid adhesives and the like.

BRIEF DESCRIPTION OF THE DRAWINGS

FIG. 1 shows a two-layer film 2 composed of a first layer 4 of polymer and a second layer 6 of copper. The polymer layer 4 is transparent to a beam of pulse laser while copper layer 6 is opaque to the beam of pulse laser so that any beam of pulse laser directed at the copper layer 6 will not penetrate the copper layer 6 to contact polymer layer 4. As shown in FIG. 1, discontinuous areas 5 are defined by exposed areas of polymer layer 4 that are not covered by copper layer 6. These discontinuous areas 5 in this two-layer film 2 can be used to impart a laser-engraved pattern to a surface using a conventional type laser apparatus.

FIGS. 2 and 3 show the two-layer film 2 of FIG. 1 wrapped around a print roll 8. As shown in FIG. 3, print roll 8 comprises a steel substrate 12 coated with a ceramic coating 14. As discussed above, when the two-layer film 2 is disposed about print roll 8, a beam of pulse laser could be directed across the area of the print roll 8 so that the beam of energy would be absorbed and/or reflected by the exposed copper areas 6 and transmitted through the exposed polymer areas 4. The pulse laser would penetrate into the areas covered by the exposed polymer areas 5 and form wells in the ceramic coated layer 14 on print roll 8. After the laser engraving, the two-layer film 2 could be removed thereby exposing the laser-engraved print roll. FIG. 6 shows a laser-engraved roll 16 that could be produced using the two-layer film 2 of FIGS. 1, 2, and 3. Laser-engraved roll 16 is shown with a plurality of wells 18 in which each group of wells form a discontinuous patterns 7 corresponding to the exposed polymer areas 5 shown in FIG. 2.

Figure 6:
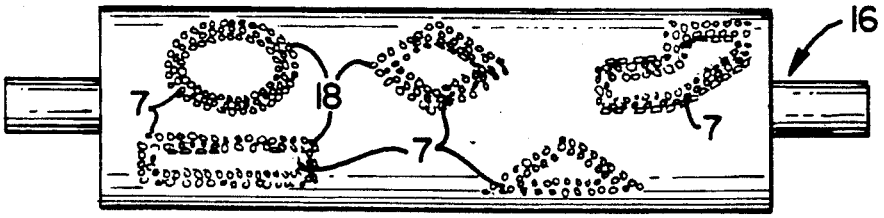
FIG. 6 is a side elevational view of a laser-engraved print roll produced in accordance with this invention.
Figure 9:
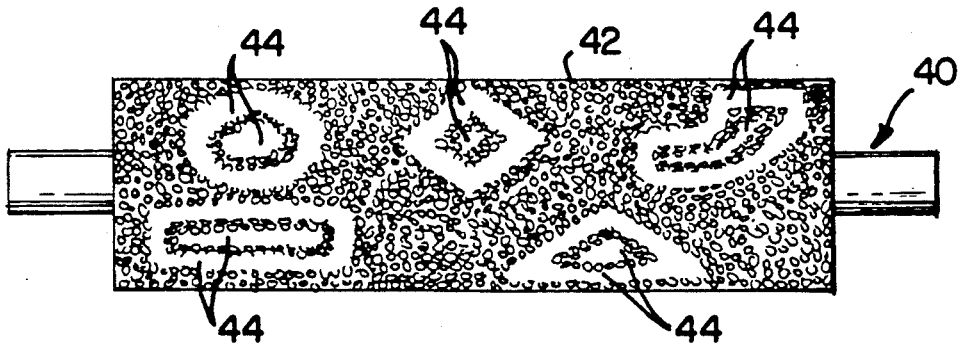
FIG. 9 is a side elevational view of a laser-engraved print roll produced in accordance with this invention.

The laser wells shown on FIGS. 6 and 9 are illustrated larger than would be produced in practice so that the invention can be better understood. In practice each well would be so small that it would not be seen by the human eye.

Figure 2:
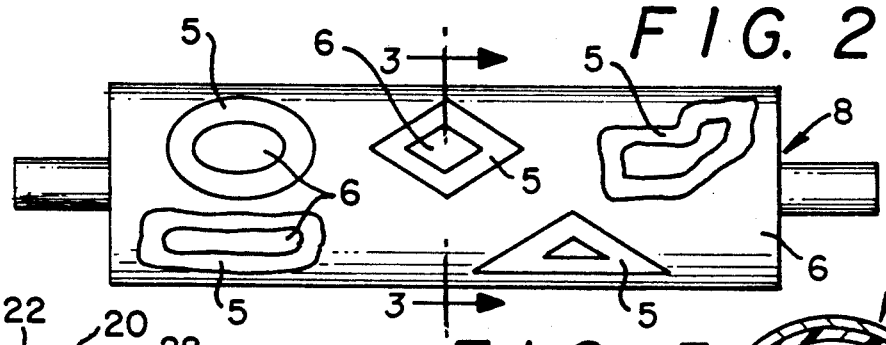
FIG. 2 is a side elevational view of a print roll covered with the two-layer mask sheet of FIG. 1.
Figure 3:
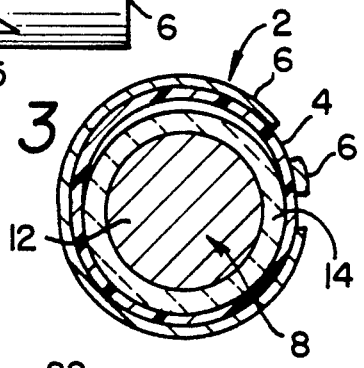
FIG. 3 is a cross-sectional view of the print roll of FIG. 2 taken through line 3—3.
Figure 5:
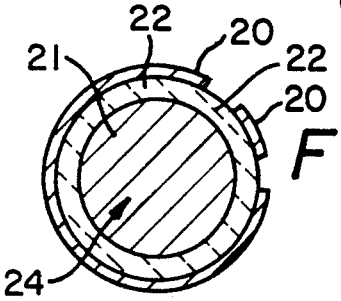
FIG. 5 is a cross-sectional view of the print roll of FIG. 4 taken through line 4—4.
Figure 4:
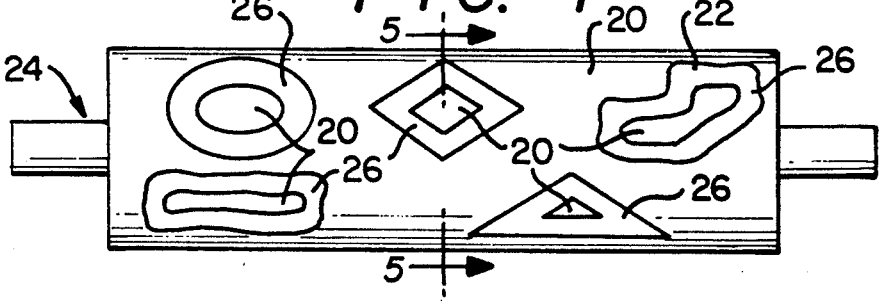
FIG. 4 is a side elevation view of a print roll coated with a mask material for use in this invention.

FIGS. 4 and 5 illustrate another embodiment of the invention in which a copper layer 20 of a desirable pattern is deposited on the surface of a ceramic coated layer 22 on a steel substrate 21 of print roll 24. As discussed above, the copper layer 20 could be deposited on a ceramic coated print roll 24 and then by depositing a resist layer on the copper, followed by selectively exposing the resist layer to light to produce a desired pattern, the remaining resist layer and copper can be removed leaving the geometric shapes 26 of exposed ceramic areas on print roll 24 as shown in FIGS. 4 and 5. Specifically, FIG. 4 shows a ceramic coated print roll 24 having deposited on its surface a layer of copper 20 which has exposed areas 26 of the ceramic coated material 22 on print roll 24. Laser-engraving of print roll 24 will cause the beam of laser pulses to be absorbed and/or reflected by the copper layer and penetrate the coated layer 22. Upon removal of the copper by mechanical or chemical means, a laser-engraved print roll 16 will be produced of the type shown in FIG. 6. Thus the laser-engraved print roll 16 of FIG. 6 can be produced using the two-layer film shown in FIGS. 1 to 3 or by the depositing of copper directly on a print roll as shown in FIGS. 4 and 5.

Figure 1:
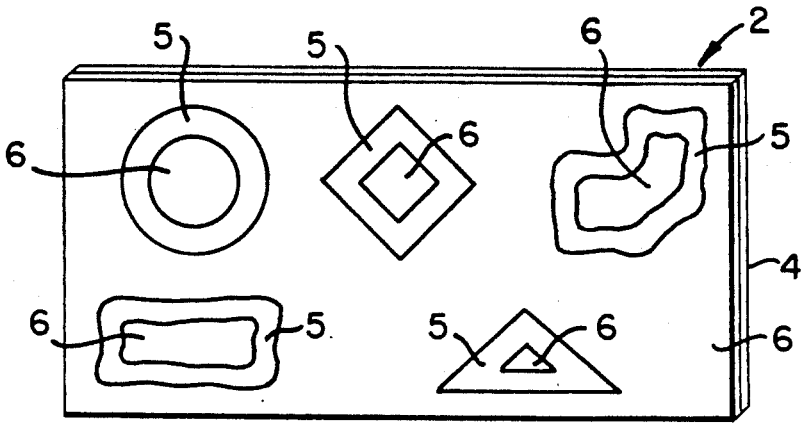
FIG. 1 is a front oblique view of a two-layer mask sheet for us in this invention.
Figure 7:
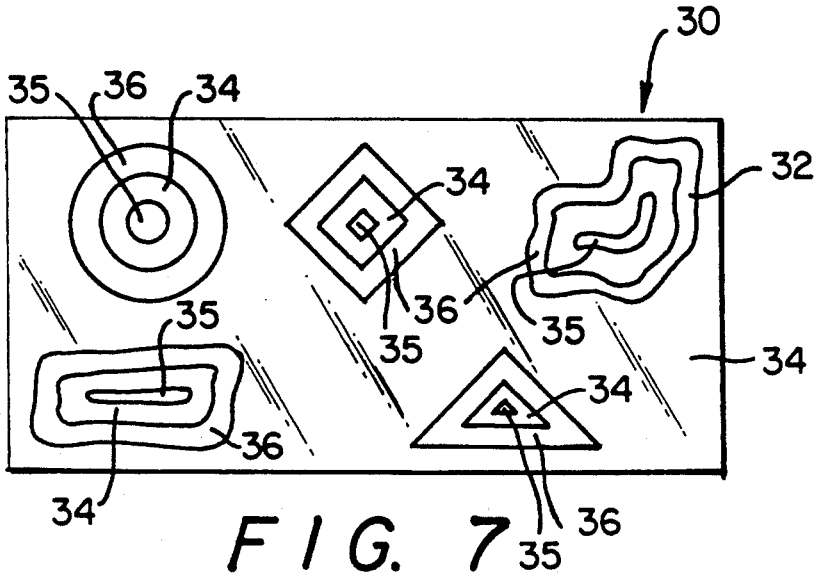
FIG. 7 is a front view of another two-layer mask sheet for use in this invention.

FIG. 7 shows a two-layer film 30 similar to that shown in FIG. 1 except the copper 32 dispersed on the polymer sheet 34 is similar to a negating of the copper 6 dispersed on polymer layer 4 of FIG. 1 except that an additional copper geometric shape 35 is disposed within an outer copper geometric shape 36. As shown in this FIG. 7, the copper 32 forms a plurality of independent geometric shapes 35 and 36. By superimposing this two-layer film 30 on a ceramic coated print roll and then laser engraving the print roll as discussed above, a laser-engraved print roll 40 can be produced as shown in FIG. 9 with well-free areas 44 forming geometric shapes. Note that print roll 40 contains a plurality of wells 42 for receiving liquid, such as ink so that the ink can be transferred to a receiving surface leaving a print with the geometric shapes 44 ink free.

Figure 8:
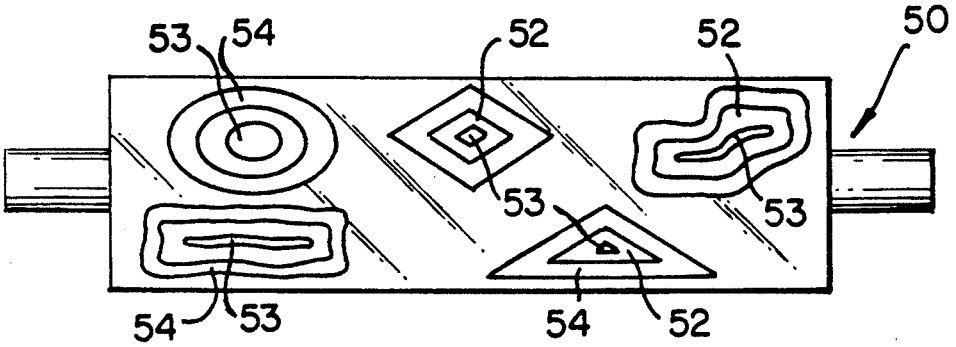
FIG. 8 is a side elevational view of another embodiment of a print roll coated with a mask material for use in this invention.

FIG. 8 shows a copper dispersed layer 52 of various geometric shapes 53 and 54 on a ceramic coated print roll 50. The dispersed copper shapes 53 and 54 can be deposited as the copper was deposited on the print roll shown in FIG. 4. Using the ceramic print roll 50 shown in FIG. 8, laser engraving the print roll 50 as discussed above, and removing the copper will produce a laser-engraved print roll 40 as shown in FIG. 9 with well-free areas 44 forming geometric shapes. Note that print roll 40 contains a plurality of wells 42 for receiving liquid, such as ink, so that the ink can be transferred to a receiving surface leaving a print with the geometric shapes 56 ink free.

EXAMPLE 1

A 150 millimeter diameter steel gravure roll was coated with a 0.012 inch layer of chromium oxide ($Cr_2O_3$). A two-layer film was prepared using a Mylar polyester film 0.010 inch thick onto which was bonded a copper foil. A non-etchable protective coating was deposited onto selected areas of the copper foil to define a discontinuous pattern in areas of the copper not coated with the protective layer. The exposed copper (uncoated copper) was etched away using ferric chloride. The copper areas remaining provided areas that would absorb and/or reflect any pulse of radiation from a laser machine.

The two-layer film was superimposed over the coated gravure roll and a laser machine using $CO_2$ was employed to produce pulses of radiation which were directed onto the two-layer film where the pulse was absorbed and/or reflected by the copper areas and transmitted through the Mylar polyester film (which did not contain any copper layer). The laser used had the following parameters:

| | |
|---|---|
| Frequency | 1300 Hz |
| Pulse width | 200 US |
| Current | 70 milliamperes |
| Average power | 65 watts |
| Energy per pulse | 50 mj (millijoules) |
| Focal length | 3.5 inches |
| Beam collinator expender | 2 times |

The pulses of radiation that were transmitted through the Mylar layer contacted the coated surface of the gravure roll and produced a plurality of depressions or wells in the coated surface. The pulses from the laser were all of uniform energy and therefore produced a plurality of uniform wells in the coated surface which defined the pattern on the roll. Thus the wells defining the boundary of the pattern had the same depth and size as the wells contained within the center of the pattern. This uniformity of wells at the boundary areas prevents the edges of the pattern when printed on a receiving surface from being fuzzy.

The laser treated coated gravure roll was microfinished using a roll composed of a film-backed diamond tape continuously moved over the coated roll at a desired speed of about 120 rpm to facilitate removal of the recast area defining the wells. The finished surface had a roughness of about 3 micro-inches $R_a$. The parameters of the wells were as follows:

| | |
|---|---|
| Well diameter as engraved | 0.122 millimeters |
| Well diameter as finished | 0.114 to 0.112 millimeters |
| Well depth as engraved | 0.075 millimeters |
| Well depth as finished | 0.063 millimeters |
| Height of recast as finished | 0.003 millimeters |

An inspection of the wells revealed that all wells at the center of the pattern and at the boundary of the wells were the same in overall dimensions therefore insuring that the rolls when used for printing would impart a pattern onto a receiving surface that did not have fuzzy edges.

EXAMPLE 2

A 150 millimeter diameter steel gravure roll was coated with a 0.012 inch layer of chromium oxide ($Cr_2O_3$). A two-layer film was prepared using a Mylar polyester film 0.010 inch thick onto which was bonded a copper foil. A non-etchable protective coating was deposited onto selected areas of the copper foil to define a discontinuous pattern in areas of the copper not coated with the protective layer. The exposed copper (uncoated copper) was etched away using ferric chloride. The copper areas remaining provided areas that would absorb and/or reflect any pulse of radiation from a laser machine.

The two-layer film was superimposed over the coated gravure roll and a laser machine using $CO_2$ was employed to produce pulses of radiation which were directed onto the two-layer film where the pulse was absorbed and/or reflected by the copper areas and transmitted through the Mylar polyester film (which did not contain any copper layer). The laser used had the following trihelical parameters:

| | |
|---|---|
| Frequency | 1000 Hz |
| Pulse width | 200 US |
| Current | 50 milliamperes |
| Average power | 53 watts |
| Energy per pulse | 53 mj (millijoules) |
| Focal length | 3.5 inches |
| Beam collinator expender | 2 times |

The pulses of radiation that were transmitted through the Mylar layer contacted the coated surface of the gravure roll and produced a plurality of depressions or wells in the coated surface. The pulses from the laser were all of uniform energy and therefore produced a plurality of uniform wells in the coated surface which defined the pattern on the roll. Thus the wells defining the boundary of the pattern had the same depth and size as the wells contained within the center of the pattern. This uniformity of wells at the boundary areas prevents the edges of the pattern when printed on a receiving surface from being fuzzy.

The laser treated coated gravure roll was microfinished using a roll composed of a film-backed diamond tape continuously moved over the coated roll at a desired speed of about 120 rpm to facilitate removal of the recast area defining the wells. The finished surface had a roughness of about 3 micro-inches $R_a$. The parameters of the wells were as follows:

| | |
|---|---|
| Well diameter as engraved | 0.122 millimeters |
| Well diameter as finished | 0.105 millimeters |
| Well depth as engraved | 0.100 millimeters |
| Well depth as finished | 0.056 millimeters |
| Height of recast as finished | 0.002 millimeters |

An inspection of the wells revealed that all wells at the center of the pattern and at the boundary of the wells were the same in overall dimensions therefore insuring that the rolls when used for printing would impart a pattern onto a receiving surface that did not have fuzzy edges.

EXAMPLE 3

A 150 millimeter diameter steel gravure roll was coated with a 0.012 inch layer of chromium oxide ($Cr_2O_3$). A two-layer film was prepared using a Mylar polyester film 0.010 inch thick onto which was bonded a copper foil. A non-etchable protective coating was deposited onto selected areas of the copper foil to define a discontinuous pattern in areas of the copper not coated with the protective layer. The exposed copper (uncoated copper) was etched away using ferric chloride. The copper areas remaining provided areas that would absorb and/or reflect any pulse of radiation from a laser machine.

The two-layer film was superimposed over the coated gravure roll and a laser machine using $CO_2$ was employed to produce pulses of radiation which were directed onto the two-layer film where the pulse was absorbed and/or reflected by the copper areas and transmitted through the Mylar polyester film (which did not contain any copper layer). The laser used had the following parameters:

| | |
|---|---|
| Frequency | 2500 Hz |

-continued

| | |
|---|---|
| Pulse width | 100 US |
| Current | 90 milliamperes |
| Average power | 65 watts |
| Energy per pulse | 26 mj (millijoules) |
| Focal length | 2.5 inches |
| Beam collinator expender | 2 times |

The pulses of radiation that were transmitted through the Mylar layer contacted the coated surface of the gravure roll and produced a plurality of depressions or wells in the coated surface. The pulses from the laser were all of uniform energy and therefore produced a plurality of uniform wells in the coated surface which defined the pattern on the roll. Thus the wells defining the boundary of the pattern had the same depth and size as the wells contained within the center of the pattern. This uniformity of wells at the boundary areas prevents the edges of the pattern when printed on a receiving surface from being fuzzy.

The laser treated coated gravure roll was microfinished using a roll composed of a film-backed diamond tape continuously moved over the coated roll at a desired speed of about 120 rpm to facilitate removal of the recast area defining the wells. The finished surface had a roughness of about 3 micro-inches $R_a$. The parameters of the wells were as follows:

| | |
|---|---|
| Well diameter as engraved | 0.08 to 0.063 millimeters |
| Well diameter as finished | 0.07 to 0.052 millimeters |
| Well depth as engraved | 0.030 millimeters |
| Well depth as finished | 0.021 millimeters |
| Height of recast as finished | 0 millimeters |

An inspection of the wells revealed that all wells at the center of the pattern and at the boundary of the wells were the same in overall dimensions therefore insuring that the rolls when used for printing would impart a pattern onto a receiving surface that did not have fuzzy edges.

EXAMPLE 4

A steel gravure roll was coated with a 0.012 layer of chromium oxide. The roll was laser engraved producing wells 0.004 millimeter deep and dispersed 200 to 300 lines per centimeter so that the surface of the coating would be more receptive for receiving a copper layer. Using conventional plasma depositing means, a layer of copper 0.15 millimeter thick was deposited on the laser-engraved coated surface. A photopolymer resist was deposited on the copper surface and a negative with a desired pattern was placed over the photopolymer resist. The exposed photopolymer resist areas in the negative was exposed to an appropriate light source whereupon the photopolymer resist was then developed. The areas of the photopolymer resist not contacted by the light source was removed leaving exposed copper areas which were also removed by conventional etching. The remaining copper areas covered by the resist could absorb and/or reflect the laser pulses.

Using a conventional laser apparatus, pulses of radiation were directed across the gravure roll such that the copper areas absorbed and/or reflected the pulses while the pulses contacted the exposed ceramic areas forming wells in such exposed ceramic areas. The copper areas remaining on the roll were then removed.

The laser treated roll was then microfinished as described in Example 3 and finished to a roughness of about 3 micro-inches $R_a$. An inspection of the wells revealed that all wells at the center of the pattern and at the boundary of the wells were the same in overall dimensions therefore insuring that the rolls when used for printing would impart a pattern onto a receiving surface that did not have fuzzy edges.

As many possible embodiments may be made by this invention without departing from the scope thereof, it being understood that all matter set forth is to be interpreted as illustrative and not in a limiting sense. For example, this invention could be used to produce liquid transfer articles that could be used to impart patterns of liquid or adhesives to paper, cloth, films, wood, steel and the like.

What is claimed is:

1. A method for producing a liquid transfer article for use in transferring a liquid to another surface comprising the steps of:

(a) coating an article with at least one layer of a coating material selected from the group consisting of refractory oxides and metallic carbides;

(b) patterning over the coated surface a removable mask material which is opaque to a laser beam comprising pulses of radiation of a selected energy level;

(c) directing said laser beam of uniform pulses of radiation with each pulse of radiation being from 0.0001 to 0.4 joule for a duration of 10 to 300 microseconds, onto the surface of the article so that the plurality of pulses of radiation produce in the area of the coated surface not covered by the mask material a pattern of uniform wells adapted for receiving liquid; and (d) removing the mask material from the coated article.

2. The method of claim 1 wherein after step (a) the following step is added:

(a') treating the coated surface to obtain a roughness of less than 20 micro-inches $R_a$.

3. The method of claim 1 wherein after step (a) the following step is added:

(a') sealing the coated surface with a sealant.

4. The method of claim 1 wherein said removable mask material in step (b) is composed of a two-layer film having a first layer substantially transparent to the beam of radiation of the selected energy level and disposed on said first layer a second layer of discontinuous material opaque to the beam of radiation of said selected energy level thereby producing a pattern in the first layer defined as the area of the first layer not covered by the second layer.

5. The method of claim 1 wherein said removable mask material is deposited onto the surface of the coated article.

6. The method of claim 3 wherein after step (a') the following step is added:

(a'') treating the coated surface to obtain a roughness of less than 20 micro-inches $R_a$.

7. The method of claim 1, 2, 4, 5 or 6, wherein after step (d) the following step is added:

(e) smoothing the surface of the laser treated article to a roughness of about 6 micro-inches $R_a$ or less.

8. The method of claim 4 wherein in step (b) the first layer is substantially transparent to the beam of radiation of at least 0.0001 to 0.4 joules and the second layer is opaque to said beam of radiation.

9. The method of claim 4 wherein in step (b) the first layer is a polyester film.

10. The method of claim 4 wherein in step (b) the second layer is selected from the group consisting of copper, nickel and gold.

11. The method of claim 4 wherein in step (b) the first layer is a polyester film and the second layer is copper.

12. The method of claim 5 wherein in step (b) the removable mask material is selected from the group consisting of copper, nickel and gold.

13. The method of claim 12 wherein in step (b) the removable mask material is copper.

14. The method of claim 1, 2, 4, 5 or 6 wherein the liquid transfer article is a gravure roll.

15. The method of claim 14 wherein the gravure roll comprises a substrate made of a material selected from the group consisting of aluminum and steel and wherein said gravure roll is coated with a material selected from the group consisting of chromium oxide, aluminum oxide, silicon oxide and mixtures thereof.

16. The method of claim 15 wherein the substrate is steel coated with a layer of chromium oxide.

17. The method of claim 1, 2 4, 5 or 6 wherein in step (c) the wells are from 10 microns to 300 microns in diameter and from 2 microns to 250 microns in depth.

* * * * *

UNITED STATES PATENT AND TRADEMARK OFFICE

CERTIFICATE OF CORRECTION

PATENT NO. : 5,047,116

DATED : September 10, 1991

INVENTOR(S) : Pierre Luthi and Christian Hidber

It is certified that error appears in the above-identified patent and that said Letters Patent is hereby corrected as shown below:

Column 1, line 12 insert before "coated" --such--

Column 2, line 6 "e.q." should read --e.g.--

Column 4, line 7 insert before "material" --the mask--

Column 6, line 23 insert before "and" --size--, line 40 delete "by" second occurrence Column 9, line 6 delete "us" and insert --use--

Column 15, claim 8, line 1 delete "at least"

Signed and Sealed this

Sixteenth Day of March, 1993

*Attest:*

STEPHEN G. KUNIN

*Attesting Officer*

*Acting Commissioner of Patents and Trademarks*